US010060265B2

(12) United States Patent
Nita et al.

(10) Patent No.: US 10,060,265 B2
(45) Date of Patent: Aug. 28, 2018

(54) TURBINE BLADE

(71) Applicant: IHI Corporation, Tokyo (JP)

(72) Inventors: Kozo Nita, Tokyo (JP); Yoji Okita, Tokyo (JP); Chiyuki Nakamata, Tokyo (JP); Kazuo Yonekura, Tokyo (JP); Seiji Kubo, Tokyo (JP); Osamu Watanabe, Tokyo (JP)

(73) Assignee: IHI CORPORATION (JP)

( * ) Notice: Subject to any disclaimer, the term of this patent is extended or adjusted under 35 U.S.C. 154(b) by 384 days.

(21) Appl. No.: 14/301,577

(22) Filed: Jun. 11, 2014

(65) Prior Publication Data

US 2014/0294598 A1 Oct. 2, 2014

Related U.S. Application Data

(63) Continuation of application No. PCT/JP2012/082576, filed on Dec. 14, 2012.

(30) Foreign Application Priority Data

Dec. 15, 2011 (JP) ..... 2011-274336

(51) Int. Cl.
*F01D 5/18* (2006.01)
*F01D 9/06* (2006.01)

(52) U.S. Cl.
CPC ..... *F01D 5/18* (2013.01); *F01D 5/186* (2013.01); *F01D 9/065* (2013.01); *F05D 2240/81* (2013.01); *F05D 2250/21* (2013.01); *F05D 2250/23* (2013.01); *F05D 2260/202* (2013.01); *F05D 2260/2212* (2013.01); *F23R 2900/03042* (2013.01); *F23R 2900/03043* (2013.01); *F23R 2900/03045* (2013.01)

(58) Field of Classification Search
CPC . F01D 5/18; F01D 5/186; F01D 5/187; F01D 9/06; F01D 9/065; F01D 25/12; F05D 2240/81; F05D 2260/202; F05D 2250/70; F05D 2250/71; F05D 2250/611
See application file for complete search history.

(56) References Cited

U.S. PATENT DOCUMENTS 4,529,358 A * 7/1985 Papell ..... F01D 5/186 415/115
5,361,828 A * 11/1994 Lee ..... F01D 5/187 165/109.1

(Continued)

FOREIGN PATENT DOCUMENTS

JP 06-093802 4/1994
JP 10-089005 4/1998

(Continued)

OTHER PUBLICATIONS

International Search Report and Written Opinion dated Feb. 19, 2013 in corresponding PCT International Application No. PCT/JP2012/082576.

*Primary Examiner* — Logan Kraft
*Assistant Examiner* — Danielle M Christensen
(74) *Attorney, Agent, or Firm* — Ostrolenk Faber LLP

(57) ABSTRACT

The cooling effectiveness of a turbine blade that a gas turbine engine or the like is provided with is further increased by providing a convex portion that is arranged in the inner portion of a cooling air hole and that is provided projecting out from the inner wall surface of the cooling air hole.

4 Claims, 6 Drawing Sheets

(56) References Cited

U.S. PATENT DOCUMENTS

| | | | | |
|---|---|---|---|---|
| 2004/0265488 | A1 | 12/2004 | Hardwicke et al. | 427/180 |
| 2009/0304499 | A1 | 12/2009 | Strock et al. | 415/175 |
| 2010/0040459 | A1* | 2/2010 | Ohkita | F01D 5/186 415/177 |
| 2011/0311369 | A1* | 12/2011 | Ramachandran | F01D 5/186 416/97 R |

FOREIGN PATENT DOCUMENTS

| | | |
|---|---|---|
| JP | 2001-012204 | 1/2001 |
| JP | 2004-169694 | 6/2004 |
| JP | 2005-180339 | 7/2005 |
| JP | 3719466 | 11/2005 |
| JP | 3997986 | 10/2007 |
| JP | 4752841 | 8/2011 |
| JP | 2011-196360 | 10/2011 |
| WO | WO 2008/059620 A1 | 5/2008 |

* cited by examiner

TURBINE BLADE

The present invention relates to a turbine blade.

This application is a Continuation of International Application No. PCT/JP2012/082576, filed on Dec. 14, 2012, claiming priority based on Japanese Patent Application No. 2011-274336, filed Dec. 15, 2011, the content of which is incorporated herein by reference in their entity.

TECHNICAL FIELD

Background Art

Turbine blades that a gas turbine engine or the like is provided with reach a high temperature due to being exposed to combustion gas generated by a combustor. For this reason, various countermeasures have been implemented as shown in Patent Documents 1 to 4 in order to enhance the heat resistance of turbine blades. For example, Patent Document 3 discloses a turbine blade that partitions cooling air that is jetted out from a cooling hole with a projection.

PRIOR ART DOCUMENTS

Patent Documents

[Patent Document 1] Japanese Patent No. 3997986
[Patent Document 2] Japanese Patent No. 4752841
[Patent Document 3] Japanese Unexamined Patent Application, First Publication No. H10-89005
[Patent Document 4] Japanese Unexamined Patent Application, First Publication No. H06-093802

DISCLOSURE OF THE INVENTION

Problems to be Solved by the Invention

However, in Patent Document 3, since the top of the projection is open, the cooling air that rides over the projection is subject to being blown away by the main flow gas (combustion gas) that flows upward. That is to say, a portion of the cooling air ends up being blown away without heading along the outer wall surface of the blade body. For this reason, it is not possible to sufficiently improve the cooling effectiveness.

In recent years, further improvements in the output of gas turbine engines and the like have been sought, and thereby the temperature of the combustion gas generated in the combustor has more than ever before trended toward high temperatures.

For this reason, further improvement of the cooling effectiveness is required for turbine blades that a gas turbine engine and the like is provided with.

The present invention was achieved in view of the aforementioned circumstances, and has as its object to further raise the cooling effectiveness of turbine blades that a gas turbine engine and the like is provided with.

Means for Solving the Problems

The present invention adopts the following constitution.

The first aspect of the present invention is a turbine blade that is provided with a cooling air hole that penetrates from the inner wall surface to the outer wall surface of a blade body that is made to be hollow, and provided with a convex portion that is arranged in the inner portion of the cooling air hole and that is provided projecting out from the inner wall surface of the cooling air hole.

According to the second aspect of the present invention, in the first aspect, the convex portion is provided on the inner wall surface of the cooling air hole that is positioned at the downstream side of the flow direction of the main flow gas that flows along the outer wall surface of the blade body.

According to the third aspect of the present invention, in the first or the second aspect, the cooling air hole has a straight pipe portion that is provided at the inner wall surface side of the blade body and a diameter expansion portion that is provided at the outer wall surface side of the blade body, and the convex portion is provided at the straight pipe portion or at a connection region of the straight pipe portion and the diameter expansion portion.

According to the fourth aspect of the present invention, in the first or the second aspect, the cooling air hole has a straight pipe portion that is provided at the inner wall surface side of the blade body and a diameter expansion portion that is provided at the outer wall surface side of the blade body, and the convex portion is provided continuously from an end portion of the straight pipe portion on the inner wall surface side of the blade body to an end portion of the straight pipe portion on the outer wall surface side of the blade body.

Effects of the Invention

In the present invention, since the convex portion is provided in the inner portion of the cooling air hole, the cooling air that has ridden over the convex portion is not affected by other flows such as a main flow gas. For this reason, it is possible to cause most of the cooling air that is jetted out from the cooling air hole to contribute to film cooling, without a portion of the cooling air being blown away by the main flow gas. Moreover, since the cooling air spreads out while flowing due to riding over the convex portion, it becomes possible to jet out the cooling air in a wider range.

According to the present invention, it is possible to jet out the cooling air in a wide range without reducing the cooling air that contributes to the cooling of the outer wall surface of the blade body, and so it is possible to raise the cooling effectiveness of the turbine blade.

BRIEF DESCRIPTION OF THE DRAWINGS

FIG. 2A is a vertical cross-sectional view of an outline drawing of the film cooling portion that the turbine blade in the first embodiment of the present invention is provided with.

FIG. 2B is a plan view including the convex portion of an outline drawing of the film cooling portion that the turbine blade in the first embodiment of the present invention is provided with.

FIG. 2C is a front elevation seen from the inner wall surface side of the blade body of an outline drawing of the film cooling portion that the turbine blade in the first embodiment of the present invention is provided with.

FIG. 6A is a vertical cross-sectional view of an outline drawing of the film cooling portion that the turbine blade in the second embodiment of the present invention is provided with.

FIG. 6B is a plan view including the convex portion of an outline drawing of the film cooling portion that the turbine blade in the second embodiment of the present invention is provided with.

FIG. 6C is a front elevation seen from the inner wall surface side of the blade body of an outline drawing of the film cooling portion that the turbine blade in the second embodiment of the present invention is provided with.

EMBODIMENTS FOR CARRYING OUT THE INVENTION

Hereinbelow, one embodiment of the turbine blade according to the present invention shall be described with reference to the drawings. Note that in the following drawings, the scale of each member is suitably altered in order to make each member a recognizable size.

First Embodiment

Figure 1:
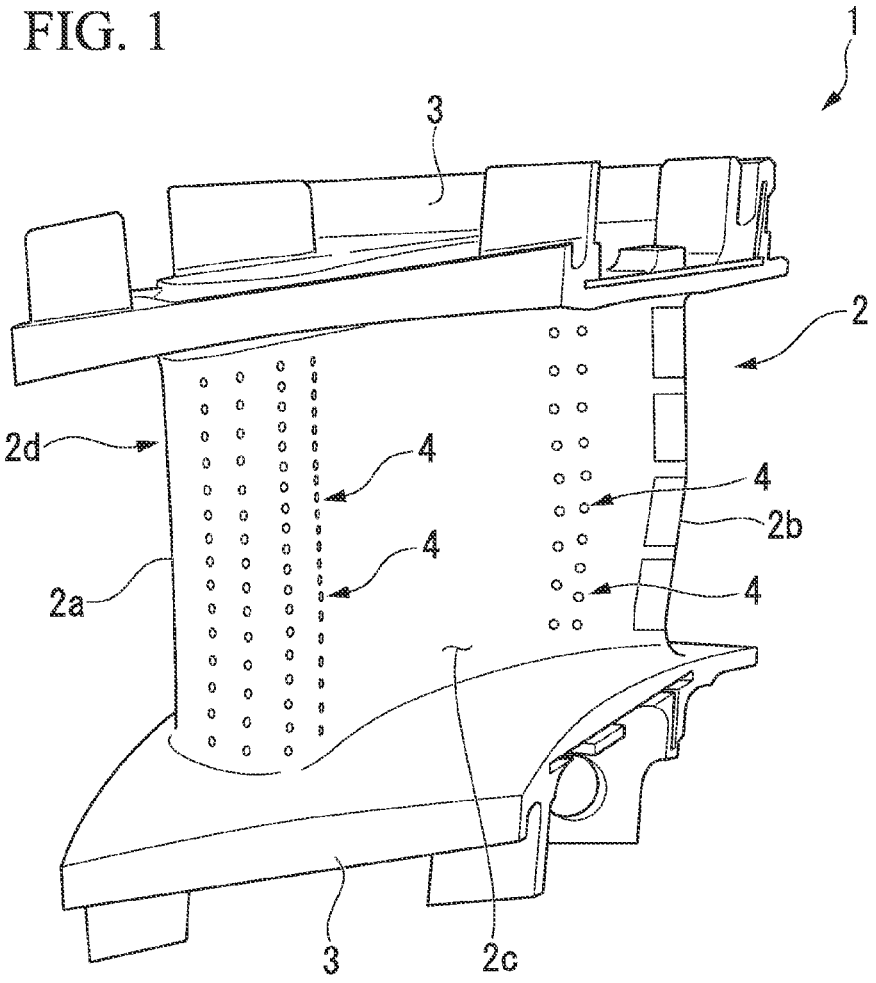
FIG. 1 is a perspective view that shows an outline configuration of the turbine blade in the first embodiment of the present invention.

FIG. 1 is a perspective view that shows the outline configuration of the turbine blade 1 of the present embodiment. The turbine blade 1 of the present embodiment is a turbine stator blade, and is provided with a blade body 2, band portions 3 that sandwich the blade body 2, and a film cooling portion 4.

The blade body 2 is arranged on the downstream side of a combustor that is not illustrated, and is arranged in the flow path of a combustion gas G (refer to FIG. 2A) that is generated by the combustor. This blade body 2 is made to have a blade shape having a leading edge 2*a*, a trailing edge 2*b*, a positive pressure surface 2*c*, and a negative pressure surface 2*b*. The blade body 2 is made to be hollow, to have an interior space for guiding cooling air to the inside. A cooling air flow path not illustrated is connected to the interior space of the blade body 2 whereby, for example, air that is extracted from a compressor that is installed on the upstream side of the combustor is introduced as the cooling air. The band portions 3 are provided sandwiching the blade body 2 from the height direction of the blade body 2, and function as a portion of the flow path wall of the combustion gas G These band portions 3 are integrated with the tip side and hub side of the blade body 2.

Figure 2A:
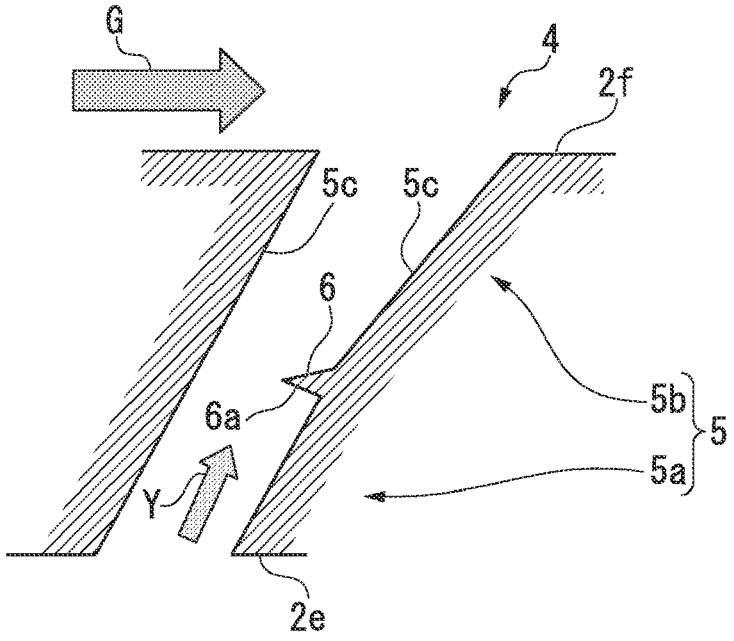
Figure 2B:
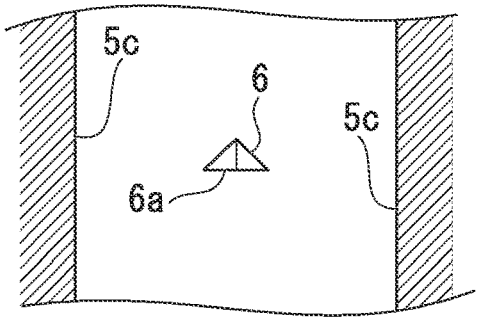
Figure 2C:
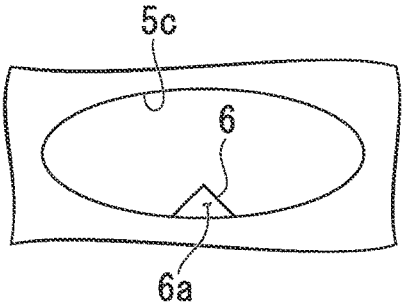

FIG. 2A is a vertical cross-sectional view of an outline drawing of the film cooling portion 4. FIG. 2B is a plan view including a convex portion 6 described below of an outline drawing of the film cooling portion 4. FIG. 2C is a front elevation seen from the inner wall surface 2*e* side of the blade body 2 of an outline drawing of the film cooling portion 4. As shown in these drawings, the film cooling portion 4 is provided with a cooling air hole 5 and a convex portion 6.

The cooling air hole 5 is a through-hole that penetrates from the inner wall surface 2*e* to the outer wall surface 2*f* of the blade body 2, and is constituted from a straight pipe portion 5*a* on the inner wall surface 2*e* side, and a diameter expansion portion 5*b* at the outer wall surface 2*f* side. The straight pipe portion 5*a* is a section that extends in a linear shape, and the cross section shown in FIG. 2A is made to have a long hole shape. Also, the straight pipe portion 5*a* is sloped so that the end portion of the outer wall surface 2*f* side is arranged further to the downstream side of the main flow gas G that flows along the outer wall surface 2*f* of the blade body 2 than the end portion on the inner wall surface 2*e* side. The diameter expansion portion 5*b* is a section whose flow path cross section increases heading toward the outer wall surface 2*f* Note that the diameter expansion portion 5*b* is made to be a shape in which the side wall surface 5*c* shown in FIG. 2A, FIG. 2B, and FIG. 2C broadens in the height direction of the blade body 2 heading from the inner wall surface 2*e* side to the outer wall surface 2*f* side.

This kind of cooling air hole 5 guides cooling air Y that is supplied from the interior space of the blade body 2 to the outer wall surface 2*f*, and after dispersing and spreading out the cooling air Y in the height direction of the blade body 2 in the diameter expansion portion 5*b*, jets it out it along the outer wall surface 2*f*.

The convex portion 6 is arranged in the inner portion of the cooling air hole 5, and is provided projecting from the inner wall surface of the cooling air hole 5. As shown in FIG. 2A, FIG. 2B, and FIG. 2C, the convex portion 6 is made to have a triangular pyramid shape in which the inner wall surface 2*e* of the blade body 2 side of the convex portion 6 is made to be a triangular collision surface 6*a*. Also, the convex portion 6 is provided at a region positioned on the downstream side of the flow direction of the combustion gas G (main flow gas), in the inner wall surface of the cooling air hole 5. Moreover, the convex portion 6 is provided at a connection region of the straight pipe portion 5*a* and the diameter expansion portion 5*b*.

Note that as shown in FIG. 1, a plurality of the film cooling portions 4 that are constituted as described above are provided in the turbine blade 1 of the present embodiment. The cooling air Y that is jetted out from this kind of film cooling portion 4 flows along the outer wall surface 2*f* of the blade body 2, and thereby the outer wall surface 2*f* of the blade body 2 is film cooled.

According to the turbine blade 1 of the present embodiment that has this kind of constitution, the cooling air flows into the cooling air hole 5 of the film cooling portion 4 from the inner part of the blade body 2. The cooling air Y that has flowed into the cooling air hole 5 is guided in a straight manner by the straight pipe portion 5*a* in which the flow path surface area does not change, and in the diameter expansion portion 5*b* in which the flow path surface area widens in a continuous way, flows while spreading in the height direction of the blade body 2. Thereby, according to the cooling air hole 5 that the turbine blade 1 of the present embodiment is provided with, compared with a cooling air hole that consists only of a straight pipe portion, it is possible to jet out the cooling air Y in a wider range in the height direction of the blade body 2, and so it is possible to cool the outer wall surface 2*f* of the blade body 2 in a wider range.

Also, in the turbine blade 1 of the present embodiment, the convex portion 6 is provided in the inner portion of the cooling air hole 5. For this reason, the cooling air Y that has ridden over the convex portion 6 is not affected by the flow of the combustion gas G For this reason, it is possible to cause most of the cooling air Y that is jetted out from the cooling air hole 5 to contribute to film cooling, without a portion of the cooling air Y being blown away by the combustion gas G Moreover, since the cooling air Y spreads out while flowing due to riding over the convex portion 6, it becomes possible to jet out the cooling air Y in a wider range.

In this way, according to the turbine blade 1 of the present embodiment, it is possible to jet out the cooling air Y in a wide range without reducing the cooling air Y that contributes to the cooling of the outer wall surface 2*f* of the blade body 2, and so it is possible to raise the cooling effectiveness of the turbine blade 1.

Also, the convex portion 6 in the turbine blade 1 of the present embodiment is arranged in the inner wall surface of the cooling air hole 5, on the downstream side of the flow direction of the combustion gas G that flows along the outer wall surface 2*f* of the blade body 2. Thereby, it becomes possible to broadly jet out the cooling air Y in the height direction of the blade body 2.

Also, in the turbine blade 1 of the present embodiment, the convex portion 6 is provided at the connection region of the straight pipe portion 5*a* and the diameter expansion portion 5*b*. Since the diameter expansion portion 5*b* is spatially wider than the straight pipe portion 5*a*, due to the provision of the convex portion 6 in the connection region of the straight pipe portion 5*a* and the diameter expansion portion 5*b*, it is possible to ensure a space for the cooling air Y, which attempts to spread out by riding over the convex portion 6, to spread out. Accordingly, it is possible to jet out the cooling air Y in a wider range without the spreading out of the cooling air Y being impeded.

Figure 3:
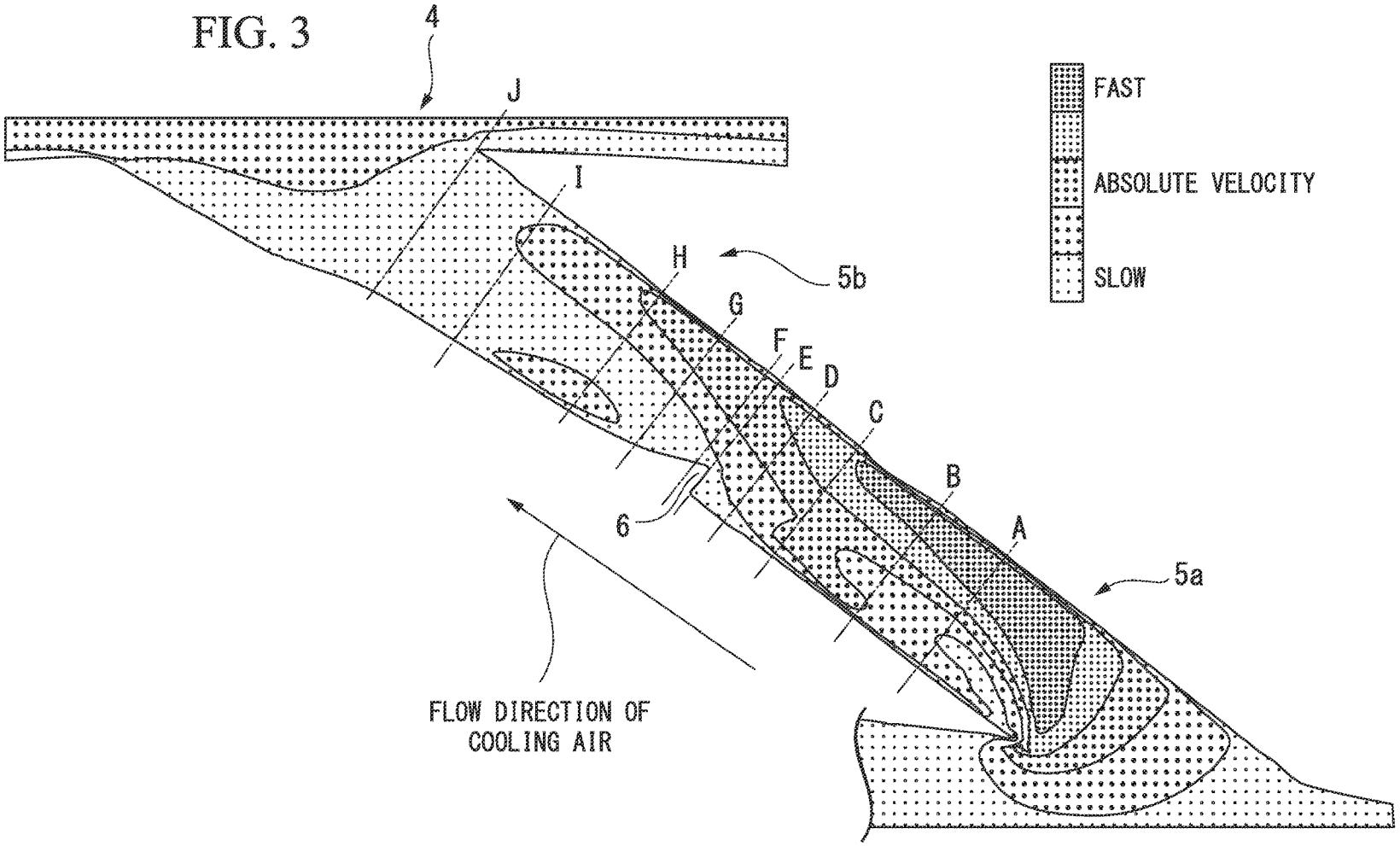
FIG. 3 is a schematic drawing that shows the distribution of the absolute velocities obtained by simulation that used the film cooling portion the turbine blade in the first embodiment of the present invention is provided with as a model.
Figure 4:
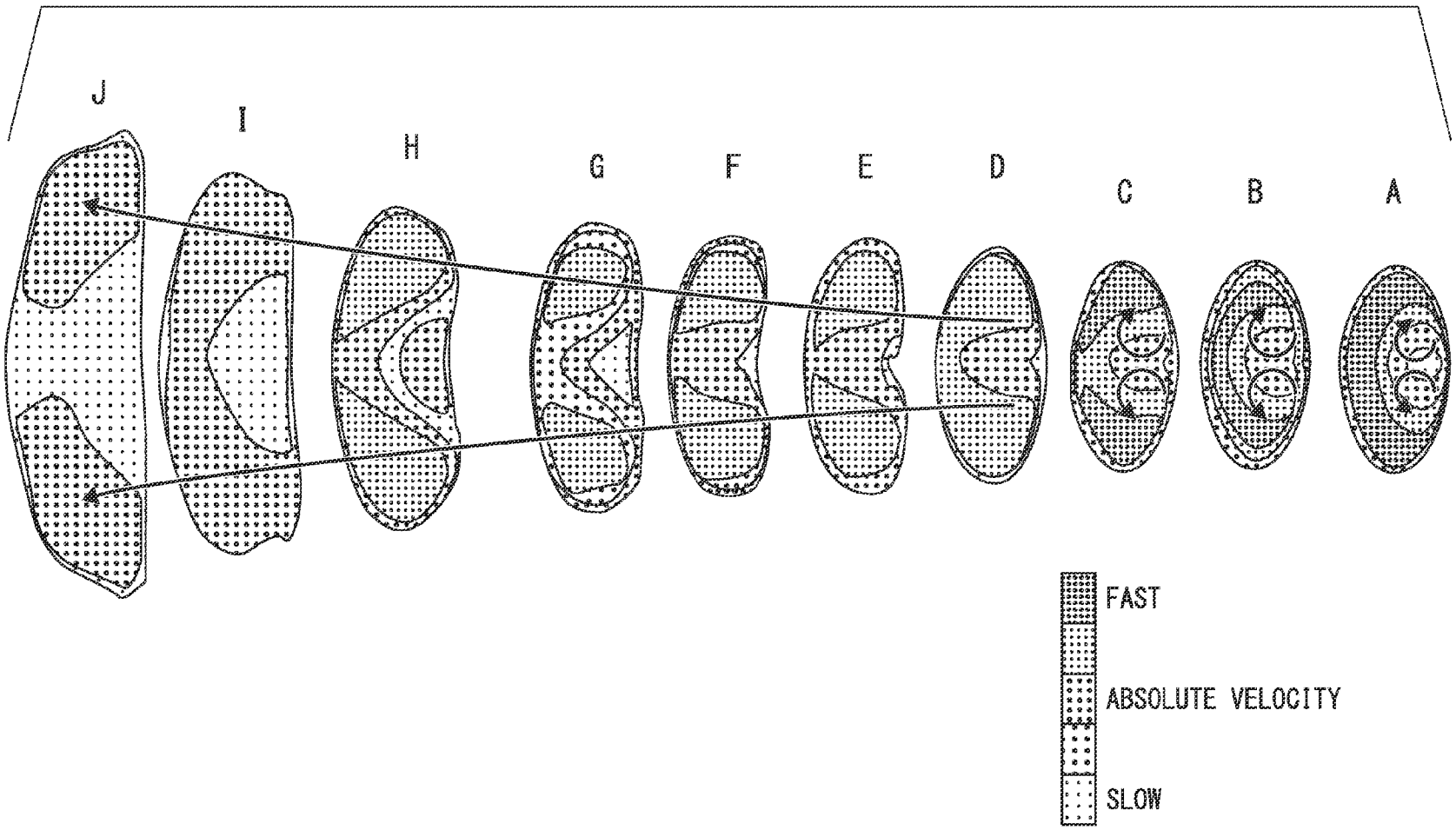
FIG. 4 is a schematic drawing that shows the absolute velocities and flow directions at cross section A to cross section J in FIG. 3.
Figure 5:
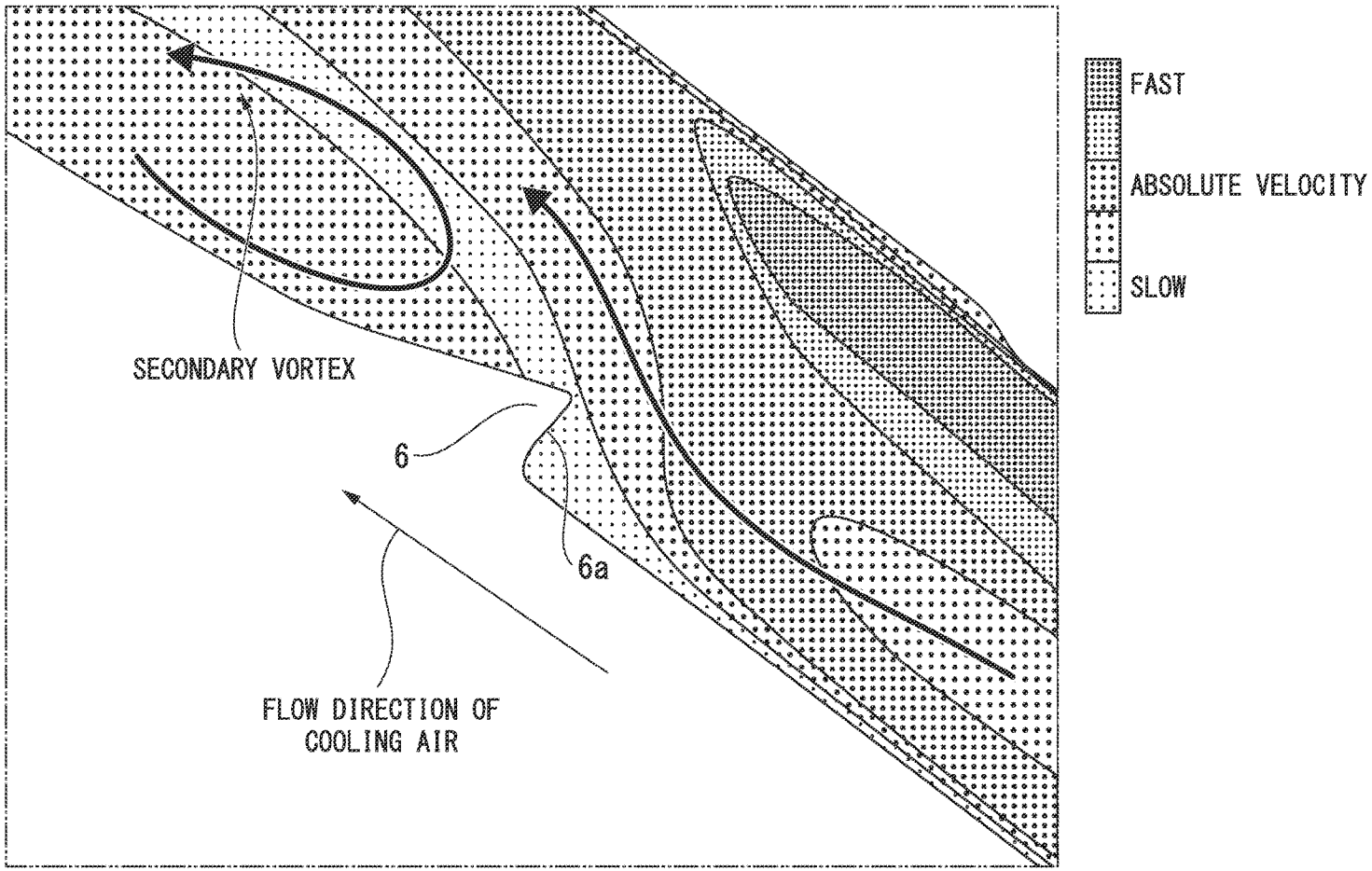
FIG. 5 is a schematic drawing that shows the absolute velocities and flow directions in the vicinity of the convex portion in FIG. 3.

FIG. 3 to FIG. 5 are drawings that schematically show the result of simulating flows in the film cooling portion 4 of the turbine blade 1 of the present embodiment. FIG. 3 shows the distribution of the absolute velocities of the cooling air Y in the film cooling portion 4, FIG. 4 shows the absolute velocities and local flow directions of the cooling air Y at cross-section A to cross-section J in FIG. 3, and FIG. 5 shows the absolute velocities and local flow directions in the vicinity of the convex portion 6. Note that as shown in FIG. 3 and FIG. 5, the cooling air Y flows from the straight pipe portion 5*a* side toward the diameter expansion portion 5*b*. Also, in FIG. 4 and FIG. 5, the local flow directions of the cooling air Y in the inner portion of the cooling air hole 5 are indicated with bold arrows.

As shown in these drawings (particularly E to J of FIG. 4), in the turbine blade 1 of the present embodiment, it is possible to confirm that the cooling air Y that has ridden over the convex portion 6 has spread out in the height direction of the blade body 2 without being affected by the combustion gas G.

Also, as shown in FIG. 5, it is apparent that a secondary vortex is formed at the downstream side of the convex portion 6.

Due to the formation of this kind of secondary vortex, the pressure loss in the inner portion of the cooling air hole 5 rises, and so it is possible to reduce the flow speed of the cooling air Y. As a result, the cooling air Y more easily spreads out in a wider range.

Second Embodiment

Next, the second embodiment of the present invention shall be described. Note that in the description of the present embodiment, descriptions of those portions that are the same as in the first embodiment described above shall be omitted or simplified.

Figure 6A:
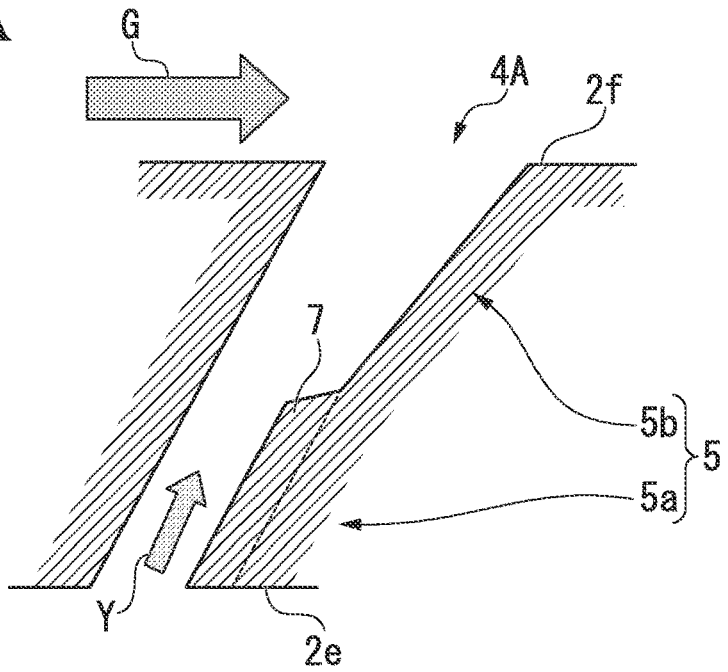
Figure 6B:
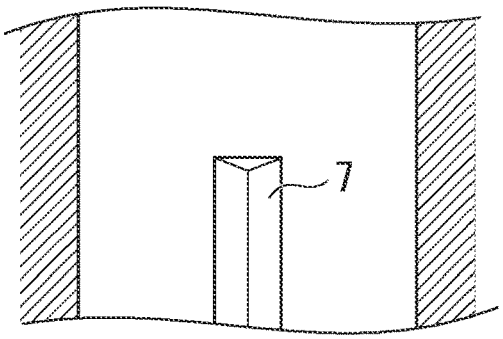
Figure 6C:
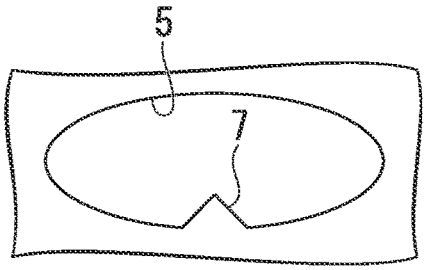

FIG. 6A is a vertical cross-sectional view of an outline drawing of the film cooling portion 4A that the turbine blade of the present embodiment is provided with. FIG. 6B is a plan view including a convex portion 7 described below of an outline drawing of the film cooling portion 4A that the turbine blade of the present embodiment is provided with. FIG. 6C is a front elevation seen from the inner wall surface 2*e* side of the blade body 2 of an outline drawing of the film cooling portion 4A that the turbine blade of the present embodiment is provided with. As shown in these drawings, the film cooling portion 4A is provided with a convex portion 7 that is long in the direction that joins the inner wall surface 2*e* and the outer wall surface 2*f* of the blade body 2, instead of the convex portion 6 of the above embodiment.

The convex portion 7 is arranged in the inner portion of the cooling air hole 5, and is provided projecting from the inner wall surface of the cooling air hole 5. Also, as shown in FIG. 6A, FIG. 6B, and FIG. 6C, the convex portion 7 is made to have a triangular column shape in which the inner wall surface 2*e* of the blade body 2 side of the convex portion 7 is made to be a triangle shaped. Also, the convex portion 7 is provided continuously from the end portion on the inner wall surface 2*e* of the blade body 2 side of the straight tube portion 5*a* to the end portion on the outer wall surface 2*f* of the blade body 2 side of the straight tube portion 5*a*.

In the turbine blade 1 of the present embodiment that has this kind of constitution, the cooling air Y that has ridden over the convex portion 7 is not affected by the flow of the combustion gas G For this reason, it is possible to cause most of the cooling air Y that is jetted out from the cooling air hole 5 to contribute to film cooling, without a portion of the cooling air Y being blown away by the combustion gas G. Moreover, since the cooling air Y spreads out while flowing due to riding over the convex portion 7, it becomes possible to jet out the cooling air Y in a wider range.

In this way, in the turbine blade of the present embodiment, it is possible to jet out the cooling air Y in a wide range without reducing the cooling air Y that contributes to the cooling of the outer wall surface 2*f* of the blade body 2, and so it is possible to raise the cooling effectiveness of the turbine blade.

Hereinabove, preferred embodiments of the present invention are described while referring to the appended drawings, but the present invention is not limited to the aforementioned embodiments. The various shapes and combinations of each constituent member shown in the embodiments described above refer to only examples, and may be altered in various ways based on design requirements and so forth within a scope that does not deviate from the subject matter of the present invention.

For example, the arrangement position and number of the film cooling portion 4 in the blade body 2 of the aforementioned embodiments are just one example, and are suitably changeable in accordance with the cooling performance that is required in the turbine blade.

Also, in the aforementioned embodiments, a description is given for a constitution in which the turbine blade is a stator blade. However, the present invention is not limited thereto, and does not exclude constitutions that install film cooling portions in the rotor blade.

Also, the shape of the convex portions 6 and 7 in the aforementioned embodiments are just examples, and for example are changeable to other shapes such as a square column or a semicircular column shape.

Also, the convex portion 6 in the aforementioned embodiment may be installed in the inner portion of the straight pipe portion 5*a*.

INDUSTRIAL APPLICABILITY

In a turbine blade that a gas turbine engine or the like is provided with, it is possible to jet out cooling air in a wide range without reducing the cooling air that contributes to the cooling of the outer wall surface of a hollow blade body, and it is possible to raise the cooling effectiveness of the turbine blade.

DESCRIPTION OF THE REFERENCE SYMBOLS

1: Turbine blade
2: Blade body
2*a*: Leading edge
2*b*: Trailing edge
2*c*: Positive pressure surface
2*d*: Negative pressure surface
2*e*: Inner wall surface
2*f*: Outer wall surface
3: Band portion
4, 4A: Film cooling portion
5: Cooling air hole
5*a*: Straight pipe portion
5*b*: Diameter expansion portion
6: Convex portion
6*a*: Collision surface
G: Combustion gas (main flow gas)
Y: Cooling air

The invention claimed is:

1. A turbine blade that is provided with a cooling air hole that penetrates from an inner wall surface to an outer wall surface of a blade body that is made to be hollow, the turbine blade comprising:

a convex portion configured to form a secondary vortex within the cooling air hole such that a center axis of the secondary vortex is within the cooling air hole, the convex portion being within the cooling air hole and being provided projecting out from the inner wall surface of the cooling air hole, wherein the convex portion has a triangular pyramid shape in which a side wall surface of the blade body side of the convex portion is made to be a triangular collision surface, the convex portion is provided on the side wall surface of the cooling air hole that is positioned at the downstream side of the flow direction of the main flow gas that flows along the outer wall surface of the blade body, and the triangular collision surface is perpendicular to the side wall surface of the cooling air hole.

2. The turbine blade according to claim 1, wherein the cooling air hole has a straight pipe portion that is provided at the inner wall surface side of the blade body and a diameter expansion portion that is provided at the outer wall surface side of the blade body, and the convex portion is provided at the straight pipe portion.

3. The turbine blade according to claim 1, wherein the cooling air hole has a straight pipe portion that is provided at the inner wall surface side of the blade body and a diameter expansion portion that is provided at the outer wall surface side of the blade body, and the convex portion is provided at a connection region of the straight pipe portion and the diameter expansion portion.

4. A turbine blade that is provided with a cooling air hole that penetrates from an inner wall surface to an outer wall surface of a blade body that is made to be hollow, the turbine blade comprising:

a convex portion configured to form a secondary vortex within the cooling air hole such that a center axis of the secondary vortex is within the cooling air hole, the convex portion being within the cooling air hole and being provided projecting out from a side wall surface of the cooling air hole, wherein the cooling air hole has a straight pipe portion that is provided at the inner wall surface side of the blade body and a diameter expansion portion that is provided at the outer wall surface side of the blade body, and the convex portion is provided continuously from an end portion on the inner wall surface of the blade body side of the straight pipe portion to an end portion on the outer wall surface of the blade body side of the straight pipe portion the convex portion has a triangular column shape, and the convex portion is provided on the side wall surface of the cooling air hole that is positioned at the downstream side of the flow direction of the main flow gas that flows along the outer wall surface of the blade body.

* * * * *